US011076244B2

(12) United States Patent
Kvist

(10) Patent No.: US 11,076,244 B2
(45) Date of Patent: Jul. 27, 2021

(54) HEARING INSTRUMENT HAVING A DIGITALLY TUNABLE ANTENNA

(71) Applicant: GN Hearing A/S, Ballerup (DK)

(72) Inventor: Søren Kvist, Vaerlose (DK)

(73) Assignee: GN Hearing A/S

( * ) Notice: Subject to any disclaimer, the term of this patent is extended or adjusted under 35 U.S.C. 154(b) by 0 days.

(21) Appl. No.: 16/213,526

(22) Filed: Dec. 7, 2018

(65) Prior Publication Data

US 2019/0200144 A1 Jun. 27, 2019

(30) Foreign Application Priority Data

Dec. 22, 2017 (EP) ..... 17210409

(51) Int. Cl.
*H04R 25/00* (2006.01)

(52) U.S. Cl.
CPC ..... *H04R 25/554* (2013.01); *H04R 25/604* (2013.01); *H04R 25/552* (2013.01); *H04R 25/70* (2013.01); *H04R 2225/021* (2013.01); *H04R 2225/025* (2013.01); *H04R 2225/51* (2013.01); *H04R 2225/61* (2013.01)

(58) Field of Classification Search
CPC .... H04R 25/70; H04R 25/552; H04R 25/554; H04R 25/604; H04R 2225/021; H04R 2225/025; H04R 2225/51; H04R 2225/61
See application file for complete search history.

(56) References Cited

U.S. PATENT DOCUMENTS 8,604,980 B2 * 12/2013 Asrani ..... H01Q 1/243 343/700 MS
9,680,209 B2 * 6/2017 Troelsen ..... H04R 25/305
9,706,318 B2 * 7/2017 So ..... H04R 25/65
(Continued)

FOREIGN PATENT DOCUMENTS

CN 104796838 7/2015
EP 2579460 4/2013
(Continued)

OTHER PUBLICATIONS

Extended European Search Report and Search Opinion dated Feb. 27, 2018 for corresponding European Application No. 17210409.3.
(Continued)

*Primary Examiner* — Brian Ensey
(74) *Attorney, Agent, or Firm* — Vista IP Law Group, LLP

(57) ABSTRACT

A hearing instrument is provided comprising a microphone for reception of sound and conversion of the received sound, a signal processor for processing the received sound into an audio signal compensating a hearing loss of a user, a speaker connected to the signal processor, and a wireless communication unit connected to the signal processor for wireless communication, the wireless communication unit being interconnected with an antenna structure for emission and reception of an electromagnetic field, the antenna structure comprising an antenna element having a first end and a second end, wherein the first end is connected to a feed of the antenna structure, and wherein a controllable component is provided in series with the antenna element, the controllable component being configured to change one or more characteristics of the antenna structure.

25 Claims, 8 Drawing Sheets

(56) References Cited

U.S. PATENT DOCUMENTS

| | | | | |
|---|---|---|---|---|
| 9,966,992 | B2 * | 5/2018 | Secall | H04B 1/713 |
| 10,129,915 | B2 * | 11/2018 | Nezhad-Ahmadi | H04W 76/10 |
| 2010/0054512 | A1 * | 3/2010 | Solum | H04R 25/30 381/315 |
| 2012/0093324 | A1 * | 4/2012 | Sinasi | H01Q 1/273 381/23.1 |
| 2013/0090074 | A1 | 4/2013 | Christensen | |
| 2017/0041043 | A1 | 2/2017 | Secall | |
| 2017/0325033 | A1 | 11/2017 | Aubreville et al. | |

FOREIGN PATENT DOCUMENTS

| | | | |
|---|---|---|---|
| EP | 2 750 408 | A1 | 7/2014 |
| EP | 2750408 | | 7/2014 |
| EP | 2835863 | A1 | 2/2015 |
| EP | 3132544 | | 2/2017 |

OTHER PUBLICATIONS

Foreign Office Action dated Jan. 28, 2021 for EP Appln. No. 17210409.3.

Foreign OA for CN Patent Appln. No. 201811570503.7 dated Jun. 17, 2021.

* cited by examiner

HEARING INSTRUMENT HAVING A DIGITALLY TUNABLE ANTENNA

RELATED APPLICATION DATA

This application claims priority to, and the benefit of, European Patent Application No. EP 17210409.3 filed on Dec. 22, 2017. The entire disclosure of the above application is expressly incorporated by reference herein.

TECHNICAL FIELD

The present disclosure relates to hearing instruments, such as hearing instruments for compensating a hearing loss of a user, particularly hearing instruments having wireless communication capabilities and thus hearing instruments comprising antennas for communication, and particularly hearing instruments having a tunable, such as a digitally tuneable, antenna.

BACKGROUND

Hearing instruments have over the later years been increasingly able to communicate with the surroundings, including communicating with remote controls, spouse microphones, other hearing instruments and lately also directly with smart phones and other external electronic devices.

Hearing instruments are very small and delicate devices and to fulfil the above requirements, the hearing instruments need to comprise many electronic and metallic components contained in a housing small enough to fit in the ear canal of a human or behind the outer ear. The many electronic and metallic components in combination with the small size of the hearing instrument housing impose high design constraints on the radio frequency antennas to be used in hearing instruments with wireless communication capabilities.

Thus, antennas, typically radio frequency antennas, in the hearing instruments have to be designed to achieve connectivity with a wide range of devices to obtain good communication for all sizes and shapes of heads, ears and hair, in all environments and with as large frequency bandwidth as possible despite the space limitation and other design constraints imposed by the size of the hearing aid.

In some antenna structures an antenna shortening/lengthening component in the form of a capacitance or an inductance is used to change the resonance frequency of the antenna structure.

In some antenna structures, impedance matching is used to achieve maximum power transfer over a transmission line, and the line impedance is configured to match both the radio and the antenna.

SUMMARY

It is an object to overcome at least some of the disadvantages as mentioned above, and it is a further object to provide a hearing instrument with increased wireless communication capabilities.

According to a first aspect, a hearing instrument is provided, the hearing instrument comprising a microphone for reception of sound and conversion of the received sound into a corresponding first audio signal. The hearing instrument comprising a first signal processor for processing the first audio signal into a second audio signal, e.g. compensating a hearing loss of a user of the hearing instrument, a speaker connected to an output of the signal processor for converting the second audio signal into an output sound signal, a wireless communication unit connected to the signal processor for wireless communication. The wireless communication unit is interconnected with an antenna structure for emission and reception of an electromagnetic field, the antenna structure comprising an antenna element having a first end and a second end, wherein the first end is connected to a feed of the antenna structure. A controllable component may be provided in series with the antenna element, the controllable component being configured to change a characteristic of the antenna structure.

According to a second aspect, a method of operating a hearing instrument is provided, the hearing instrument comprising a microphone for reception of sound and conversion of the received sound into a corresponding first audio signal, a signal processor for processing the first audio signal into a second audio signal compensating a hearing loss of a user of the hearing instrument, a speaker connected to an output of the signal processor for converting the second audio signal into an output sound signal, a wireless communication unit connected to the signal processor for wireless data communication and being interconnected with an antenna structure for emission and reception of an electromagnetic field, the antenna structure comprising an antenna element having a first end and a second end, wherein the first end is connected to a feed of the antenna structure. A controllable component is provided and may be provided in series with the antenna element. The method comprising receiving a data communication signal, determining a signal strength of the received data communication signal and providing a control signal to the controllable component in response to the determined signal strength, controlling the controllable component to change a characteristic of the antenna structure in response to the control signal.

The controllable component may be a digitally controllable component, and the antenna structure may be a digitally tuneable antenna structure.

In some embodiments, the controllable component is provided between the first end of the antenna element and the second end of the antenna element, or the controllable component may be provided between the second end of the antenna element and a ground connection for the antenna.

The first end of the antenna element may be an antenna terminal.

The wireless communication unit is configured for wireless communication, including wireless data communication, and is in this respect interconnected with the antenna for emission and reception of an electromagnetic field. The wireless communication unit may comprise a transmitter, a receiver, a transmitter-receiver pair, such as a transceiver, a radio unit, etc. The wireless communications unit may be configured for communication using any protocol as known for a person skilled in the art, including Bluetooth, including Bluetooth Low Energy, Bluetooth Smart, etc., WLAN standards, manufacture specific protocols, such as tailored proximity antenna protocols, such as proprietary protocols, such as low-power wireless communication protocols, such as CSR mesh, etc.

In some embodiments, the antenna structure is an electromechanical antenna structure and the controllable component may be configured to change one or more electromechanical characteristics of the antenna structure. The electro-mechanical characteristics of the antenna include antenna impedance, electrical length of the antenna, radiation pattern, radiation efficiency, polarization electrical length of the antenna, etc.

In some embodiments, the characteristics of the antenna structure are digitally tuned to optimized performance of the antenna structure. Hereby, the antenna structure may be digitally tuned to optimize performance of the antenna in a given environment or under given circumstances.

In some embodiments, when a characteristic of the antenna structure is changed, the current distribution along the antenna element and/or the frequency response of the antenna structure may be change.

The controllable component may comprise one or more adjustable components selected from the group of: resistors, capacitors, inductors, diodes and transistors. The controllable component may be an adjustable capacitor, such as a digitally adjustable capacitor. The controllable component may be an adjustable inductor, such as a digitally adjustable inductor. The controllable component may comprise a switching device, such as s single pole, double throw electrical switch, such as an SPDT, an SP3T or an SP4T, etc., enabling connection to three, four, etc., components, adjustable or static. In some embodiments the controllable component may comprise a switching device, such as a single pole, double throw electrical switch, such as an SPDT, an SP3T or an SP4T, etc., electrical switch enabling connection to three, four, etc., components, adjustable or static, the static components being selected from the group of: resistors, capacitors, inductors, diodes and transistors. The static components typically having a fixed value.

In some embodiments parameters of the controllable component are configured to be adjusted in response to the control signal. For example, the resistance of a resistor may be adjusted, the capacitance of a capacitor may be adjusted, the inductance of an inductor may be adjusted, the switch position of a switch may be adjusted to connect to a different component, such as to a component of a different type, such as to a component of a different parameter value. Accordingly, also the DC voltage of diodes and transistors may be adjusted.

In some embodiments, the controllable component may have a predetermined number of settings, such as a predetermined number of parameter values. The controllable component may be configured to switch between the predetermined number settings, and thus the predetermined number of parameter values, in response to receiving the control signal. For example, the control signal may indicate which of the predetermined number of parameter settings should be used. In some embodiments, each predetermined parameter setting is allocated a specific channel.

In some embodiments, the controllable component may be adjusted in a continuous way, allowing for a continuous adjustment of parameter values.

A processor of the hearing instrument, suchs as a second signal processor, and/or the wireless communication unit may comprise a received signal quality indicator. In some embodiments, the second processor and/or the wireless communication unit stores historic data for received signal quality and controllable component settings.

In some embodiments, the controllable component is configured to change one or more characteristica of the antenna structure during a fitting procedure for a hearing instrument, such as during an audiologic fitting procedure.

In some embodiments, the controllable component is configured to change one or more characteristica of the antenna structure during calibration of a hearing instrument, such as during an audiologic calibration procedure, such as during a post-production calibration procedure, such as during a post-production factory calibration procedure.

In some embodiments a first hearing instrument and a second hearing instrument forms part of a binaural hearing instrument. The first hearing instrument and the second hearing instrument may be calibrated with respect to each other. In some embodiments, a controllable component of a first hearing instrument is adjusted with respect to a signal received from the second hearing instrument. In some embodiments, additionally, a controllable component of the second hearing instrument is adjusted with respect to a signal received from the first hearing instrument.

The antenna structure comprises an antenna element having a first end and a second end, wherein the first end is connected to a feed of the antenna structure.

The second end of the antenna element may be an open end. The second end of the antenna element may be connected to the wireless communication unit. The second end of the antenna element may be connected to ground, such as to a ground potential.

In some embodiments, the antenna element is a resonant antenna element.

In some embodiments, the antenna element is a full wavelength antenna element. In some embodiments, the antenna element is a quarter wavelength antenna element.

In some embodiments, the first end of the antenna element is connected to the feed of the antenna structure, and the second end of the antenna element is connected to a ground potential through the controllable component.

In some embodiments, the first end of the antenna element is connected to the feed of the antenna structure, and the second end of the antenna element is an open end, the controllable component being provided between the first end and the open end.

In some embodiments, the first end of the antenna element is connected to the feed of the antenna structure, and the second end of the antenna element is connected to a ground potential through the controllable component.

In some examples, the controllable component is provided as a controllable component mounted on a support substrate arranged in the hearing instrument, such as on a printed circuit board arranged in the hearing instrument.

The antenna element may via the second end of the antenna element and an antenna terminal connect to the controllable component and the ground.

The ground for the antenna structure may be the support substrate, such as a printed circuit board. A transmission line may connect the antenna terminal to the ground via the controllable component.

In some embodiments, the controllable component is provided in proximity to the second end of the antenna element. Thus, the controllable component may be provided within a distance from the second end, such as a distance being equal to or less than 25% of the distance between the first end and the second end of the antenna element, such a distance being equal to or less than 10% of the distance between the first end and the second end of the antenna element. In some embodiments, the controllable component is provided within a distance from the second end, such as a distance being equal to or less than 0.1 wavelength, such as equal to or less than 0.05 wavelength of the electromagnetic field to be emitted and received by the antenna structure.

The hearing instrument may be any hearing instrument, such as any hearing instrument compensating a hearing loss of a user of the hearing instrument, or such as any hearing instrument providing sound to a user.

In some embodiments, the hearing instrument comprises one or more hearing instrument housing modules. The hearing instrument may comprise at least one behind-the-ear module configured to be positioned behind the ear of a user when provided in its intended operational position. The behind-the-ear module comprises at least the first signal processor and the antenna element. Traditionally, the behind-the-ear module comprises at least the first signal processor, the wireless communication unit, and in some embodiments at least one antenna element. A hearing instrument battery is typically also provided in the behind-the-ear module.

In some embodiments, a hearing instrument may be provided having a behind-the-ear module, an in-the-ear module and a connection between the two modules, such as a tube module. Typically, the hearing instrument components may be distributed between the modules. In many hearing instruments, the receiver is positioned in the in-the-ear module.

In some embodiments, the hearing instrument comprises at least one in-the-ear or completely-in-the-canal module. The at least one in-the-ear module or completely-in-the-canal module is configured to be positioned in the ear of the user when provided in its intended operational position. The in-the-ear module comprising at least the first signal processor and the antenna element.

The hearing instrument may be an in-the-ear or completely-in-the-canal type hearing instrument in which the hearing instrument is provided in the ear of a user. Thus, in some embodiments, the in-the-ear module comprises the hearing instrument components, including processors, the wireless communication unit, the battery, the microphone and speaker, etc.

It is emphasized that any combination of modules, as set out above may be envisaged, and various hearing instrument components may be accommodated in different modules.

The antenna element is preferably accommodated within the hearing instrument, such as accommodated within a hearing instrument housing module, such as accommodated within a behind-the-ear module, such as accommodated within an in-the-ear module, etc. In some embodiments, the antenna element may extend into e.g. a tube module, interconnecting a behind-the-ear module and an in-the-ear module.

The antenna element may be provided on a first side of the hearing instrument and on a second side of the hearing instrument, such as on a first side of a hearing instrument housing module and a second side of a hearing instrument housing module, such as for example on a first side of a behind-the-ear module and on a second side of a behind-the-ear module, such as for example on a first side of an in-the-ear module and a second side of an in-the-ear module.

In some embodiments, the first side of the hearing instrument, such as the first side of a hearing instrument housing module is adjacent a surface of the user's head when the hearing instrument is worn in an operational position at the ear of a user, and wherein the second side of the hearing instrument, such as the second side of the hearing instrument housing module, is opposite the first side.

In some embodiments at least a part of the antenna element extends from the first side of the hearing instrument to the second side of the hearing instrument, such as from the first side of the hearing instrument housing module to the second side of the hearing instrument housing module.

The antenna element may be configured so that the part of the antenna element extending from the first side to the second side, carries a current maximum during use.

In some embodiments, the part of the antenna element extending from the first side of the hearing instrument to the second side of the hearing instrument, extends in a direction being non-parallel to the side of the head, when the hearing instrument is positioned in the intended operational position. In some embodiments, the part of the antenna element extending from the first side of the hearing instrument to the second side of the hearing instrument, extends in a direction pointing away from the head of the user, such as in a direction being perpendicular, such as 90+/−30 degrees, to the side of the head, when the hearing instrument is positioned in the intended operational position.

In some embodiments, the hearing instrument comprises a second signal processor for evaluating received signal strength and providing a control signal to the controllable component in response to the evaluation of the received signal strength.

The second signal processor may form part of the first signal processor configured to process the first audio signal, e.g. into a second audio signal compensating a hearing loss of a user of the hearing. Alternatively, the second signal processor may be a separate signal processor.

In some embodiments, the second signal processor evaluates the strength of a signal received via the antenna structure. The received signal may be a signal received from an external device, such as hearing instrument accessory devices, such as a spouse microphone, a remote control, etc. The received signal may be a signal received from any external device, such as mobile phones, tablets, computers, intelligent wearables, etc., or from external devices such as home appliances or public information devices. The signal may be a signal from an external device such as from a second hearing instrument of a binaural hearing instrument.

The quality of the received signal may be evaluated by any known method to estimate a performance and/or reliability of the link between the wireless communication unit and any external device, for example by providing an indication of the received signal quality.

In some embodiments the received signal quality is evaluated based on the power present in a received signal. The power level may be indicated as a relative index of the power and/or the power level may be indicated in dBm. Thus, the signal quality may be based on a measurement of a received signal strength, RSS or the signal quality may be based on a received signal strength indicator, RSSI.

In some embodiments, the received signal quality is evaluated based on a bit error factor, such as number of bit errors in a signal, etc. In some embodiments, the received signal quality may be evaluated based on a packet error rate.

In some embodiments, the received signal quality is evaluated based on a bit error rate, a packet error rate, or a received signal strength measurement.

In some embodiments, a control signal is provided to the controllable component in response to the evaluation of the received signal quality. The controllable component is configured to be adjusted in response to the control signal.

Hereby, the controllable component may change one or more characteristics of the antenna structure in response to the control signal, and thus in response to the evaluation of the received signal quality. The one or more characteristics of the antenna structure may be changed to alter the received signal quality. Particularly, the characteristic of the antenna structure may be changed to improve the signal strength quality.

In some embodiments a feedback is provided to re-evaluate the received signal quality after a first adjustment of the controllable component. Thus, it is envisaged that multiple evaluations of the received signal quality may be performed generating sequentially a number of control signals, each control signal followed by corresponding adjustment of the controllable component in response to the control signal.

In the following the embodiments are described primarily with reference to a hearing instrument, such as a hearing aid. The hearing aid may be a binaural hearing aid. It is however envisaged that any embodiments or elements as described in connection with any one aspect may be used with any other aspects or embodiments, mutatis mutandis.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
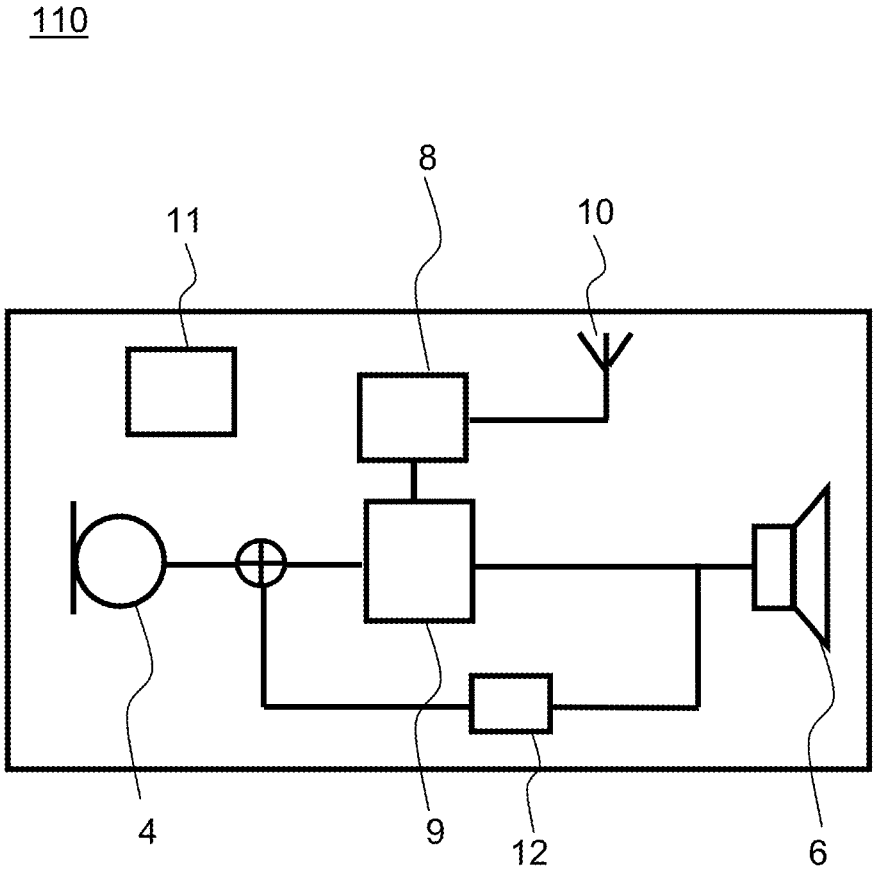
FIG. 1 shows a block-diagram of an exemplary hearing instrument according to the present disclosure.

Various embodiments are described hereinafter with reference to the figures. It should be noted that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

The claimed invention may be embodied in different forms and should not be construed as limited to the embodiments set forth herein.

A block-diagram of a hearing instrument 110 is shown in FIG. 1. The hearing instrument 110 comprises a first transducer, i.e. microphone 4, for receiving incoming sound and converting it into an audio signal, i.e. a first audio signal. The first audio signal is provided to a signal processor 9 for processing the first audio signal into a second audio signal compensating a hearing loss of a user of the hearing aid. A receiver 6 is connected to an output of the signal processor 9 for converting the second audio signal into an output sound signal, e.g. a signal modified to compensate for a user's hearing impairment, and provides the output sound to the receiver 6. Typically, the receiver 6 comprises a transducer, and the receiver may be referred to as a speaker.

Thus, the hearing instrument signal processor 9 comprises elements such as amplifiers, compressors and noise reduction systems etc. The hearing instrument or hearing aid may further have a filter function, such as compensation filter 12 for optimizing the output signal. The hearing aid may furthermore have a wireless communication unit 8 for wireless data communication interconnected with an antenna structure 10 for emission and reception of an electromagnetic field. The wireless communication unit 8, such a radio or a transceiver, connect to the hearing instrument signal processor 9 and the antenna structure 10, for communicating with external devices, or with another hearing instrument, such as another hearing instrument, located at another ear, typically in a binaural hearing instrument system. The hearing instrument 110 further comprises a power source 11, such as a battery.

The hearing instrument may be a behind-the ear hearing instrument, and may be provided as a behind-the-ear module, the hearing instrument may be an in-the-ear module and may be provided as an in-the-ear module. Alternatively, parts of the hearing instrument may be provided in a behind-the-ear module, while other parts, such as the receiver 6, may be provided in an in-the-ear module.

Figure 2:
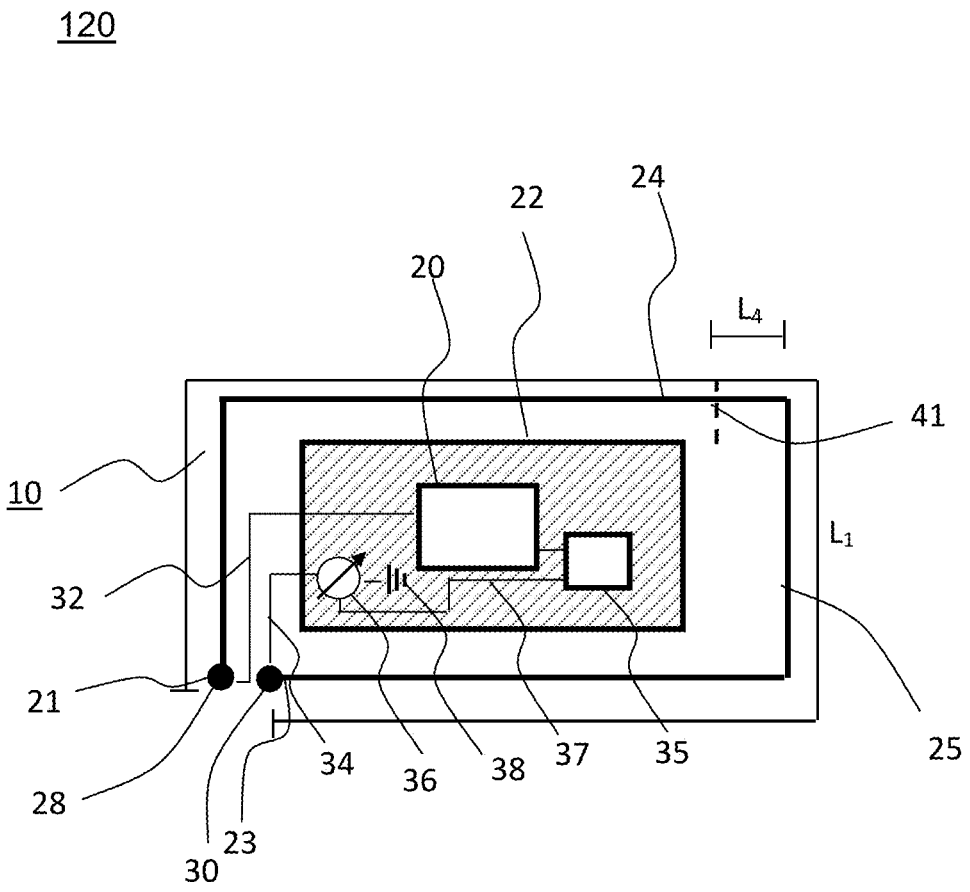
FIG. 2 shows schematically a hearing instrument with an antenna according to the present disclosure.
Figure 3:
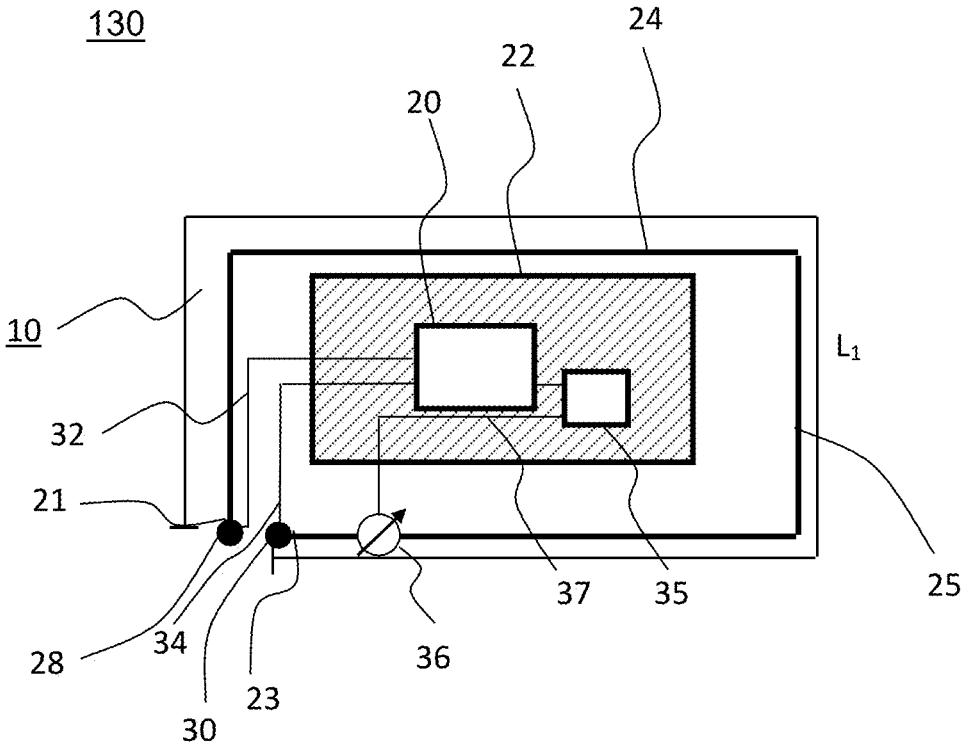
FIG. 3 shows schematically a hearing instrument with an antenna according to the present disclosure.

FIGS. 2 and 3 show schematically hearing instruments with an antenna structure 10 for emission and reception of an electromagnetic field according to the present disclosure.

In FIG. 2, a wireless communication unit 20 is provided at a printed circuit board 22, or a similar structure for supporting the wireless communication unit 20 in the hearing instrument. The wireless communication unit 20 is connected to a first antenna terminal 28 via transmission line 32. A second antenna terminal 30 is interconnected to a ground 38 via transmission line 34 and through controllable component 36. The antenna structure 10 comprises an antenna element 24 having a first end 21 and a second end 23, wherein the first end 21 is connected to a feed of the antenna structure at the first antenna terminal 28 and the second end 23 of the antenna element 24 is connected to the second antenna terminal 30. The antenna structure 10 furthermore comprises the controllable component 36 provided in series with the antenna element 24. The controllable component 36 is mounted on the printed circuit board 22, and connected to ground 38 provided at the printed circuit board 22. The length of the antenna element 24 is a full wavelength of the electromagnetic field to be emitted and received by the antenna structure 10.

In FIG. 3, an alternative position of the controllable component is shown. The wireless communication unit 20 is provided at printed circuit board 22, or a similar structure for supporting the wireless communication unit 20 in the hearing instrument. The wireless communication unit 20 is connected to a first antenna terminal 28 via transmission line 32. A second antenna terminal 30 is interconnected with the wireless communication unit 20, or alternatively connected to a ground of the printed circuit board, via transmission line 34. The antenna structure 10 comprises an antenna element 24 having a first end 21 and a second end 23, wherein the first end 21 is connected to a feed of the antenna structure at the first antenna terminal 28 and the second end 23 of the antenna element 24 is connected to the second antenna terminal 30. The antenna structure 10 furthermore comprises the controllable component 36 and the controllable component is provided in series with antenna element 24 between the first end 21 and the second end 23 of antenna element 24. In some embodiments, the controllable component 36 is provided in proximity to the second end 23 of the antenna element 24. The antenna element 24 is via the second antenna terminal 30 and transmission line 34 connected to the wireless communication unit. The length of the antenna element 24 is a full wavelength of the electromagnetic field to be emitted and received by the antenna structure 10. It is envisaged that in some embodiments, the second end 23 of the antenna element 24 may be a free end and the length of the antenna element 24 may be a quarter of wavelength, such as approx. a quarter of a wavelength.

In both FIGS. 2 and 3, the controllable component 36 is configured to change one or more characteristica of the antenna structure 10. Processor 35, such as hardware processor 35, provides a control signal 37 to the controllable component 36. The processor 35 is connected to the wireless communication unit 20 and is configured to evaluate received signal quality and providing a control signal 37 to the controllable component in response to the evaluation of the received signal quality. It should be emphasized that received signal quality may be evaluated in any way known to the skilled person, including using an evaluation based on a bit error rate, a packet error rate, or a received signal strength measurement of an incoming or received signal.

The controllable component 36 is configured to be adjusted in response to the control signal 37, for example, parameters of the controllable component 36 may be adjusted in response to the control signal.

Figure 4A:
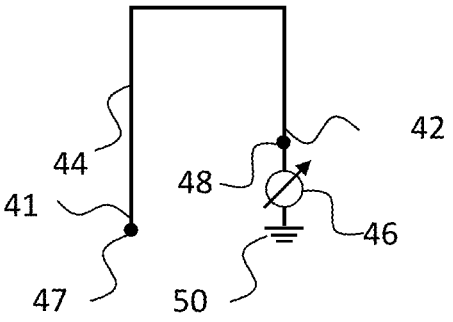
FIGS. 4*a*-4*d* show schematically antenna structures according to the present disclosure.
Figure 4B:
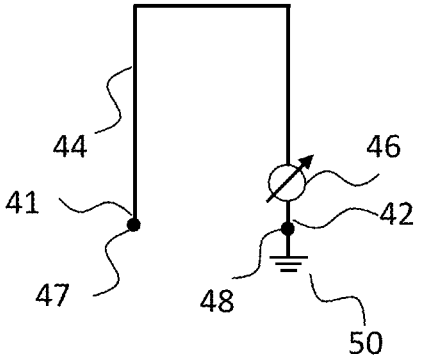
Figure 4C:
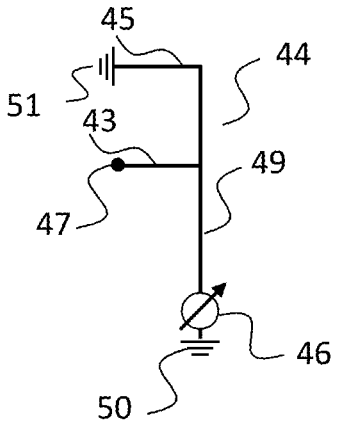

FIG. 4*a*-4*c* show schematically antenna structures according to the present disclosure.

In FIG. 4*a*, an antenna structure is shown corresponding to the antenna structure in FIG. 2. Antenna element 44 extends from first antenna terminal 47 at a first end 41 of the antenna element 44 to second antenna terminal 48 at a second end 42 of the antenna element 44. A transmission line connects the second antenna terminal 48 to controllable component 46 which further connects to ground 50. Thus, the antenna element 44 is connected to ground through the controllable component 46.

In FIG. 4*b*, an antenna structure is shown corresponding to the antenna structure in FIG. 3. Antenna element 44 extends from first antenna terminal 47 at a first end 41 of the antenna element 44 to controllable component 46 and further to second antenna terminal 48 at a second end 42 of the antenna element 44. The antenna terminal 48 is connected to ground 50. In some embodiments, the antenna terminal is connected to the wired communication unit (not shown).

The controllable component 46 is connected in series with the antenna element 44 in both FIGS. 4*a* and 4*b*.

In FIG. 4*c*, a further antenna structure according to the present disclosure is shown. The antenna element 44 has the form of an inverted F-antenna, having a first branch 43 extending from first antenna terminal 47 and a second branch 45 connecting to ground 51. The antenna element 44 further connects to controllable component 46 which further connects to ground 50. It should be noted that ground 50 and ground 51 may be a same ground, such as a same ground potential. The antenna structure is connected to the wireless communication unit (not shown), and thus fed, at antenna terminal 47. As is seen from FIG. 4*c*, the antenna is fed at an intermediate point along the antenna part 49. Thus, antenna element 44 comprises antenna part 49, first branch 43 and second branch 45. The controllable component 46 and the connection to ground 50 may be implemented as shown in FIG. 4*a* or as shown in FIG. 4*b*, respectively.

Figure 4D:
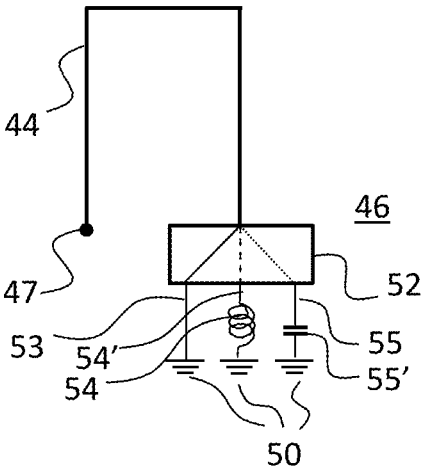

In FIG. 4*d*, a further antenna structure according to the present disclosure is shown. Antenna element 44 extends from first antenna terminal 47 at a first end 41 of the antenna element 44 to controllable component 46. The controllable component 46 and the ground 50 may be implemented as shown in either FIG. 4*a* or 4*b*, thus with the controllable component 46 being provided as part of the antenna element 44 or the controllable component 46 being provided after a second antenna terminal for the antenna element 44. The controllable component 46 is implemented as a switch 52, illustrated as a 3-way switch 52 providing three paths 53, 54, 55 to ground 50. First path 53, connects the antenna element to ground 50 via short circuit 53. Second path 54, connects the antenna element to ground 50 via coil 54'. Third path 55, connects the antenna element to ground 50 via capacitor 55'. It should be emphasized that the illustrated controllable component is exemplary and that the controllable component comprising a switch may be implemented having one path, having a plurality of paths, including two, three, four, five, etc. paths from the antenna element to the ground 50.

As illustrated in FIG. 4*d*, the controllable component may comprise one or more components, including resistors, capacitors, inductors, diodes, transistors, etc. In FIG. 4*d*, the components are illustrated by coil 54' and capacitor 55'. The components may themselves be adjustable components, and thus may contribute to the controlling of the controllable component, or the components may have fixed values, and the switch may implement the control by controlling the path selected.

Figure 5:
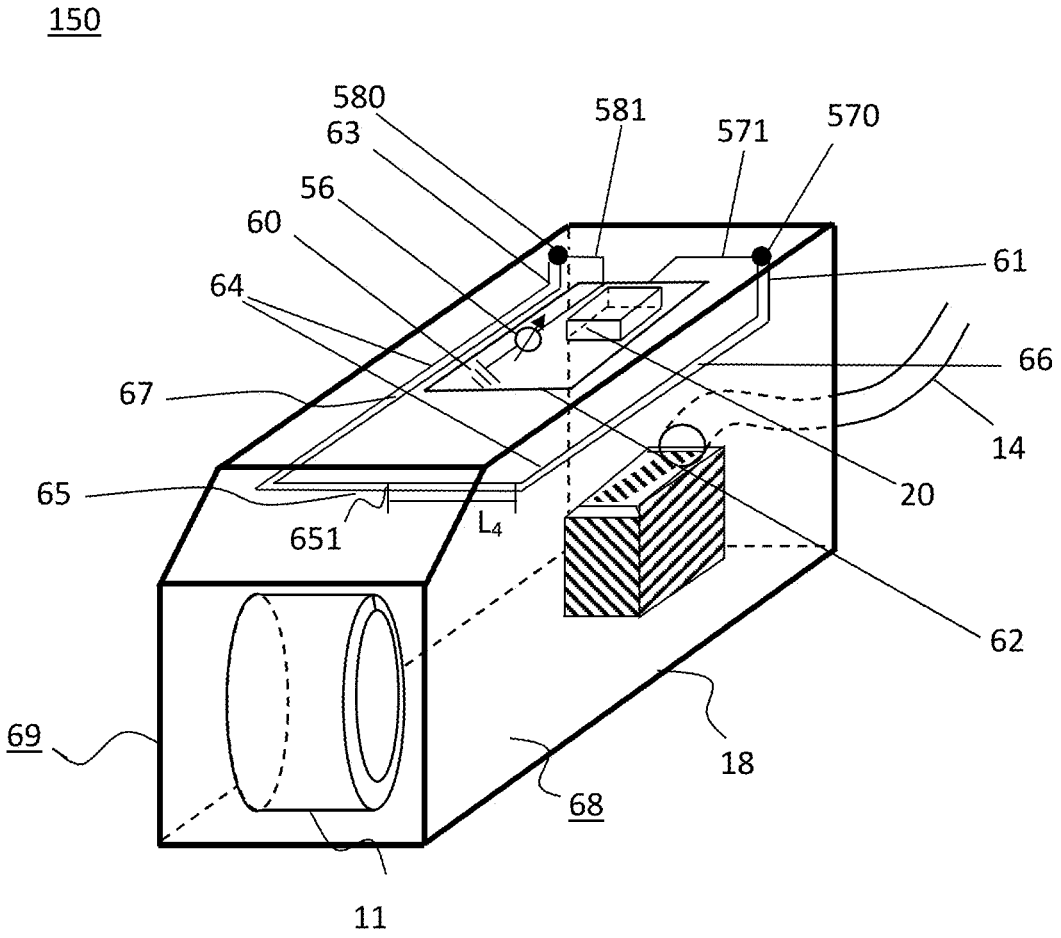
FIG. 5 shows a behind-the-ear hearing instrument according to an embodiment of the present disclosure and comprising an antenna structure.

FIG. 5 shows a hearing instrument 150 configured to be positioned behind the ear of a user and having a sound tube 14 connecting to the ear canal of a user. The hearing instrument comprises an antenna element 64, a wireless communication unit 20, a ground plane 62, a first antenna part 66 extending along a first side 68 of the hearing instrument 150, a second antenna part 67 extending along a second side 69 of the hearing instrument 150 and an antenna part 65 extending from one side 68 to the other 69. The antenna element is in a first end 61 connected to a first antenna terminal 570. The antenna element is in a second end 63 connected to a second antenna terminal 580. The hearing instrument 150 further comprises a power source, such as a battery 11.

The antenna 64 has a midpoint 651 (or a centre) which is located on the antenna part 65 or located in such a way that a distance from the midpoint 651 to the antenna part 66, 67 is not longer than $\lambda/4$. The distance from the midpoint 651 of antenna 64 and the antenna part 66, 67 may be denoted $L_4$ in FIG. 5. The structure of antenna 64 may be designed in such a way that the following holds:

$$\left|\frac{L_4 - \lambda/4}{\lambda/4}\right| < T_3$$

The absolute relative difference between the distance $L_4$ and the quarter of a wavelength $\lambda/4$ is less than a threshold, $T_3$, such as less than 10% or 25%.

The antenna may form a loop. The antenna element 64 comprising at least the first antenna part 67, the second antenna part 66, and the third antenna part 65 may be structured in such a way that the first, second, and third parts are arranged to form a loop.

The antenna extends from a first antenna terminal 570 at a first end 61 of the antenna element 64. Typically, the first antenna terminal 570 is connected to the wireless communication unit 20 via transmission line 571. The second end 63 of the antenna element is connected to second antenna terminal 580 and via transmission line 581 to controllable component 56. Controllable component 56 may in itself be controllable, or the controllable component may comprise components, such as adjustable components, and the controllable component may be controlled by a control signal received from a processor, such as from a processor of the wireless communication unit 60. The controllable component 56 is connected to ground 60. As is seen in FIG. 5, the antenna structure comprising antenna element 64, antenna terminals 570, 580, and controllable component 56, is configured so that a major part of the power of the electromagnetic field emitted by the antenna element 64 and propagating from the antenna element 65 at one ear to either an opposite ear of the user or to an external device is contributed by a midpoint of the antenna element 64. The antenna element with the controllable component is dimensioned so that the current has a maximum current amplitude at a proximity of the midpoint of the antenna, preferably located proximate a part of the antenna extending from one side of the hearing aid to another side of the hearing aid, such as at or proximate the antenna part 65 extending from a first side 68 of the hearing instrument 150 to a second side 69 of the hearing instrument. The first side 68 and the second side 69 may be opposite sides of the hearing instrument. The first side 68 and the second side 69 may be parallel sides, such as substantially parallel sides. In some embodiments, the first side 68 and the second side 69 are opposite longitudinal sides of a behind-the-ear hearing instrument 61.

The ground 60 may be a printed circuit board 62. The ground may be formed in any material capable of conducting a current upon excitation of the antenna. The ground may also be formed as a single conducting path of e.g. copper, for guiding the current. The ground may be a ground potential, such as a zero potential or a relative ground potential.

Figure 6:
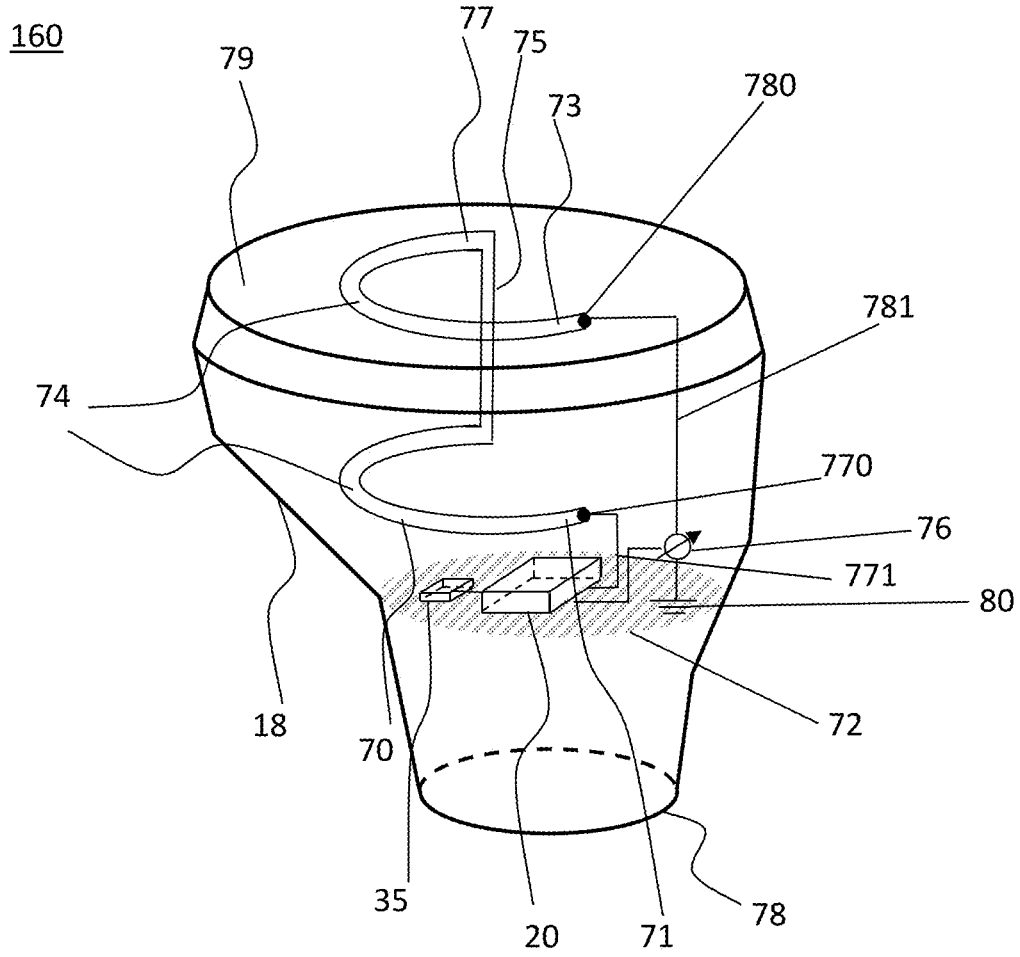
FIG. 6 shows an in-the-ear hearing instrument according to another embodiment of the present disclosure and comprising an antenna structure.

In FIG. 6 a further hearing instrument 160 is shown, the hearing instrument being configured to be positioned in the ear of a user. The hearing instrument 160 has a first side 78 which is configured to be positioned innermost in the ear of a user having a surface pointing towards the inner of the ear. The second side 79 is configured to point outwards of the ear of the user and be parallel, such as substantially parallel with the side of the head of a user. The first side 78 and the second side 79 may be opposite sides of the hearing instrument. The first side 78 and the second side 79 may be parallel sides, such as substantially parallel sides. FIG. 6 shows a hearing instrument 160 comprising an antenna element 74, a wireless communication unit 20, a ground plane 72, a first antenna part 70, a second antenna part 77 extending along the second side 79 of the hearing instrument 160 and an antenna part 75 extending from the first antenna part 70 to the second antenna part 77, preferably in a direction from the first side 78 to the second side 79 of the hearing instrument 160. The antenna element 74 is in a first end 71 connected to a first antenna terminal 770. The antenna element 74 is in a second end 73 connected to second antenna terminal 780. The hearing instrument 160 may further comprises a power source, such as a battery (not shown).

The antenna element 74 extends from a first antenna terminal 770 at a first end 71 of the antenna element 75. Typically, the first antenna terminal 770 is connected to the wireless communication unit 20 via transmission line 771. The second end 73 of the antenna element 74 is connected to second antenna terminal 780 and via transmission line 781 to controllable component 76. Controllable component 76 may in itself be controllable, controllable component 76 may be an adjustable component, or the controllable component 76 may comprise components, such as adjustable components, such as digitally adjustable components. The controllable component may be controlled by a control signal received from a processor, such as from a processor of the wireless communication unit 20. The controllable component 76 is connected to ground 80, thus also the antenna element 74 is connected to ground through controllable component 76. As is seen in FIG. 6, the antenna structure comprising antenna element 74, antenna terminals 770, 780, and controllable component 76, is configured so that a major part of the power of the electromagnetic field emitted by the antenna element 74 and propagating from the antenna element 74 at one ear to either an opposite ear of the user or to an external device is contributed by a midpoint of the antenna element 74. The antenna element 74 with the controllable component 76 is dimensioned so that the current has a maximum current amplitude at a proximity of the midpoint of the antenna, preferably located proximate a part of the antenna extending from one side of the hearing instrument to another side of the hearing instrument, such as at or proximate the antenna part 75 extending from a first side 78 of the hearing instrument 160 to a second side 79 of the hearing instrument.

The ground 80 may be a printed circuit board 72. The ground 80 may be formed in any material capable of conducting a current upon excitation of the antenna. The ground may also be formed as a single conducting path of e.g. copper, for guiding the current. The ground may be a ground potential, such as a zero potential or a relative ground potential.

Figure 7:
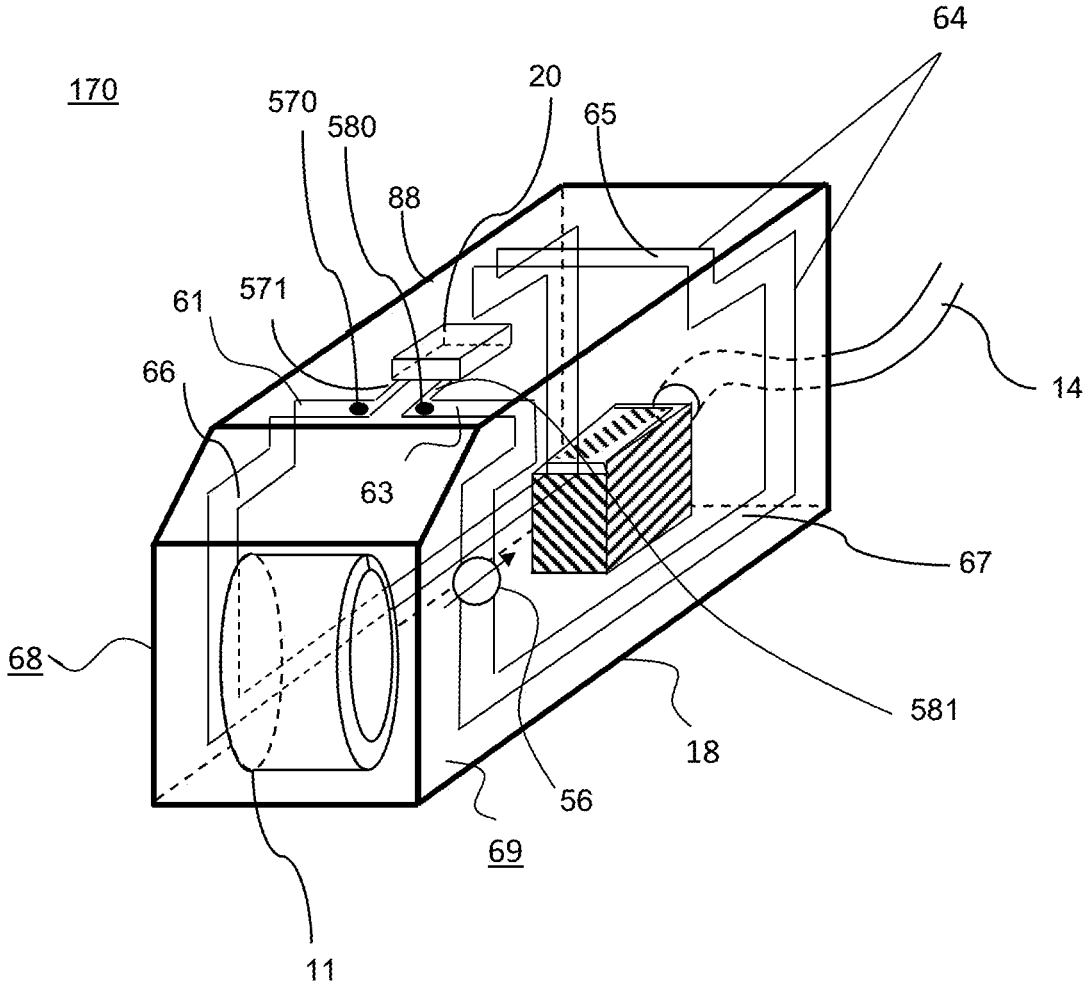
FIG. 7 shows a behind-the-ear hearing instrument according to another embodiment of the present disclosure and comprising an antenna structure.

FIG. 7 shows another hearing instrument 170 configured to be positioned behind the ear of a user and having a sound tube 14 connecting to the ear canal of a user. Like reference numerals correspond to like features as shown in FIG. 5. In FIG. 7, the controllable element is provided between the first end 61 of the antenna element 64 and the second end 63 of the antenna element 64. The controllable component is provided proximate the second end 63. The controllable component is provided along the second part 66 of the antenna element 64. The controllable component is provided along the second side of the hearing instrument. The controllable component is connected to the wireless communication unit, thus the second end 63 of the antenna element is connected to the wireless communication unit through controllable element 56.

Figure 8:
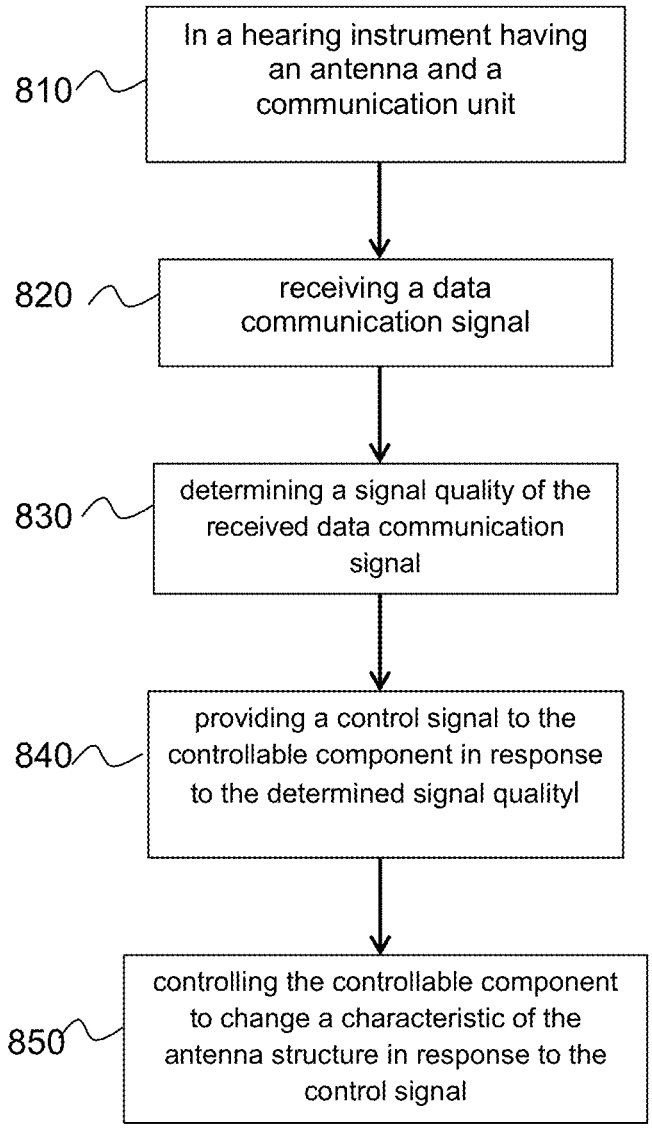
FIG. 8 is a flow chart illustrating a method of controlling a controllable element according to the present disclosure.

In FIG. 8, a flow chart of a method 800 according to the present disclosure is shown. In a hearing instrument having an antenna and a wireless communication unit, 810, a data communication signal is received, 820, such as a data communication signal from a hearing instrument positioned at another ear of a user, such as a data communication signal from an external device, such as from an accessory device, such as from a remote control, a smart phone a television set, etc. A signal quality of the received data communication signal is determined at step 830. The signal quality may be determined in any known way. The signal quality may for example be determined by evaluating a bit error rate, a packet error rate, or a received signal strength. The signal quality may be determined by a processor, such as a processor dedicated for signal quality determination, such as a processor forming part of e.g. the signal processor for processing the first audio signal into a second audio signal compensating a hearing loss of a user of the hearing instrument. A control signal signal is provided to the controllable component in response to the evaluation of the received signal quality in step 840. The control signal may be generated by the processor in response to and in accordance with the determined signal quality. In step 850, the controllable component is controlled to change a characteristic of the antenna structure in response to the control signal. Thus, the controllable component is configured to change a characteristic of the antenna structure in response to the control signal. In response to receiving the control signal, parameters of the controllable control signal may be changed, for example, parameters of the controllable component may be configured to be adjusted in response to the control signal. Thus, a value of one or more parameters may be changed upon receipt of the control signal. Typically, a re-evaluation of the received signal quality is performed upon a change in a characteristic of the antenna structure in response to the control signal.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing instrument comprising:

a microphone for reception of sound and conversion of the received sound into a corresponding first audio signal;

a signal processor configured to provide a second audio signal compensating a hearing loss of a user of the hearing instrument based on the first audio signal;

a speaker configured to provide an output sound signal based on the second audio signal;

a wireless communication unit coupled to the signal processor; and an antenna structure coupled to the wireless communication unit, wherein the antenna structure comprises an antenna element having a first end and a second end, and wherein the first end of the antenna element is physically coupled to a feed of the antenna structure;

wherein the hearing instrument further comprises a controllable component configured to change one or more characteristics of the antenna structure, wherein the controllable component is physically coupled to at least a part of the antenna element; and wherein the feed of the antenna structure is closer to the first end than to the second end of the antenna element, and wherein the controllable component is closer to the second end than to the first end of the antenna element.

2. A hearing instrument comprising:

a microphone for reception of sound and conversion of the received sound into a corresponding first audio signal;

a signal processor configured to provide a second audio signal compensating a hearing loss of a user of the hearing instrument based on the first audio signal;

a speaker configured to provide an output sound signal based on the second audio signal;

a wireless communication unit coupled to the signal processor; and an antenna structure coupled to the wireless communication unit, wherein the antenna structure comprises an antenna element having a first end and a second end, and wherein the first end of the antenna element is connected to a feed of the antenna structure;

wherein the hearing instrument further comprises a controllable component physically coupled in series with respect to at least a part of the antenna element that is configured to at least provide electromagnetic field emission, the controllable component configured to change one or more characteristics of the antenna structure; and wherein the controllable component is between the first end of the antenna element and the second end of the antenna element, or wherein the controllable component is between the second end of the antenna element and a ground connection for the antenna structure.

3. The hearing instrument according to claim 1, wherein the antenna structure comprises an electro-mechanical antenna structure, and wherein the controllable component is configured to change one or more electro-mechanical characteristics of the antenna structure.

4. The hearing instrument according to claim 1, wherein a current distribution along the antenna element and/or a frequency response of the antenna structure is variable in response to a change in a characteristic of the antenna structure.

5. The hearing instrument according to claim 1, wherein the controllable component comprises one or more adjustable components selected from the group of:

resistor(s), capacitor(s), inductor(s), diode(s), and transistor(s).

6. The hearing instrument according to claim 1, wherein the controllable component comprises an adjustable capacitor.

7. The hearing instrument according to claim 1, wherein the controllable component comprises an adjustable inductor.

8. The hearing instrument according to claim 1, wherein the controllable component comprises a switching device.

9. The hearing instrument according to claim 8, wherein the switching device comprises a single pole, double throw electrical switch.

10. The hearing instrument according to claim 1, wherein the antenna element is a resonant antenna element.

11. The hearing instrument according to claim 1, wherein the antenna element is a full wavelength antenna element, and wherein the second end is connected to a ground potential through the controllable component.

12. The hearing instrument according to claim 1, wherein the antenna element is on a first side of the hearing instrument and on a second side of the hearing instrument, wherein the first side of the hearing instrument corresponds with a surface of a head of the user when the hearing instrument is worn in an operational position at an ear of the user, and wherein the second side of the hearing instrument is opposite the first side; and wherein at least a part of the antenna element extending from the first side of the hearing instrument to the second side of the hearing instrument.

13. The hearing instrument according to claim 12, wherein the at least the part of the antenna element extending from the first side to the second side is configured to carry a maximum current.

14. The hearing instrument according to claim 1, further comprising an evaluator configured to evaluate received signal quality, and to provide a control signal to the controllable component in response to the evaluation of the received signal quality.

15. The hearing instrument according to claim 14, wherein the controllable component is configured to be adjusted in response to the control signal and/or wherein parameters of the controllable component is configured to be adjusted in response to the control signal.

16. The hearing instrument according to claim 1, wherein the hearing instrument comprises at least one behind-the-ear module configured to be positioned behind an ear of the user, the behind-the-ear module comprising the signal processor and the antenna element.

17. The hearing instrument according to claim 1, wherein the hearing instrument comprises at least one in-the-ear module configured to be positioned in an ear of the user, the in-the-ear module comprising the signal processor and the antenna element.

18. The hearing instrument according to claim 1, wherein the antenna structure is configured for electromagnetic field emission and electromagnetic field reception.

19. The hearing instrument according to claim 1, wherein the controllable component is a part of the antenna structure.

20. A method of operating a hearing instrument, the hearing instrument comprising a microphone for reception of sound and conversion of the received sound into a corresponding first audio signal, a signal processor configured to provide a second audio signal compensating a hearing loss of a user of the hearing instrument based on the first audio signal, a speaker configured to provide an output sound signal based on the second audio signal, a wireless communication unit coupled to the signal processor, and an antenna structure coupled to the wireless communication unit, the antenna structure comprising an antenna element having a first end and a second end, wherein the first end of the antenna element is physically coupled to a feed of the antenna structure, and wherein the hearing instrument also comprises a controllable component, wherein the controllable component is physically coupled to at least a part of the antenna element, wherein the feed of the antenna structure is closer to the first end than to the second end of the antenna element, and wherein the controllable component is closer to the second end than to the first end of the antenna element, the method comprising:

receiving a data communication signal;

determining a signal quality of the received data communication signal; and providing a control signal to the controllable component in response to the determined signal quality, wherein the control signal is provided to control the controllable component to change a characteristic of the antenna structure.

21. The hearing instrument according to claim 1, wherein the antenna element that is physically connected to the feed comprises a signal-radiating element, and wherein the controllable component is physically coupled with respect to the signal-radiating element.

22. The hearing instrument according to claim 21, wherein the signal-radiating element is also a signal-receiving element.

23. The hearing instrument according to claim 1, wherein the controllable component is between the first end of the antenna element and the second end of the antenna element.

24. The hearing instrument according to claim 1, wherein the controllable component is between the second end of the antenna element and a ground connection for the antenna structure.

25. A hearing instrument comprising:

a microphone for reception of sound and conversion of the received sound into a corresponding first audio signal;

a signal processor configured to provide a second audio signal compensating a hearing loss of a user of the hearing instrument based on the first audio signal;

a speaker configured to provide an output sound signal based on the second audio signal;

a wireless communication unit coupled to the signal processor; and an antenna structure coupled to the wireless communication unit, wherein the antenna structure comprises a signal-radiating element having a first end and a second end, and wherein the first end of the signal radiating element is coupled to a feed of the antenna structure;

wherein the hearing instrument further comprises a controllable component coupled physically to at least a part of the signal-radiating element, the controllable component configured to change one or more characteristics of the antenna structure, and wherein the feed of the antenna structure is closer to the first end of the signal-radiating element than to the controllable component.

* * * * *